United States Patent [19]

Weber et al.

[11] 4,437,780

[45] Mar. 20, 1984

[54] CYLINDRICAL PLATEN PRINTER WITH IMPROVED PAPER GUIDE

[75] Inventors: Wendelin Weber, Siegen; Manfred Rosenthal, Kirchen, both of Fed. Rep. of Germany

[73] Assignee: U.S. Philips Corporation, New York, N.Y.

[21] Appl. No.: 320,778

[22] Filed: Nov. 12, 1981

[30] Foreign Application Priority Data

Nov. 19, 1980 [DE] Fed. Rep. of Germany ..... 3043630

[51] Int. Cl.[3] ..... B41J 13/16

[52] U.S. Cl. ..... 400/642; 400/600.2; 400/637.1; 400/636.1; 400/645.4

[58] Field of Search ..... 400/636.1, 637.1, 642, 400/600.2, 645.4

[56] References Cited

U.S. PATENT DOCUMENTS

| | | | |
|---|---|---|---|
| 1,608,850 | 11/1926 | Going | 400/638 X |
| 2,978,087 | 4/1961 | Wendt | 400/600.2 |
| 3,750,792 | 8/1973 | Liles | 400/124 |

FOREIGN PATENT DOCUMENTS

| | | | |
|---|---|---|---|
| 2731182 | 1/1979 | Fed. Rep. of Germany | 400/642 |

*Primary Examiner*—Clifford D. Crowder
*Attorney, Agent, or Firm*—David R. Treacy

[57] ABSTRACT

For the reliable guiding of a record carrier and the printing thereon as far as in the vicinity of the upper and lower edge, a pivotable device is arranged over the printing drum, said device comprising two or more flat hold-down devices which are arranged on a rotatable shaft. The hold-down devices can be slid into a first position in which they engage the printing drum and a second position in which they are lifted off the printing drum. In the first position, the record carrier is deflected to the printing drum during transport, and in the second position it is transported by additional pressure rollers. The device is pivotable about the printing drum into three positions and is constructed as a modular unit. This enables the simultaneous or alternating transport about the printing drum of different record carriers in a different manner.

20 Claims, 8 Drawing Figures

CYLINDRICAL PLATEN PRINTER WITH IMPROVED PAPER GUIDE

BACKGROUND OF THE INVENTION

The invention relates to a printing mechanism comprising a printing member which is displaceable along the printing platen, and means for the guiding and feeding of a record carrier which is guided around the printing platen.

Underneath the printing platen, which in office machine printing mechanisms is usually a circular cylindrical drum, there are usually arranged transport rollers which are pressed against the printing platen. For introduction of a record carrier, for example a single form or sets of single forms, the transport rollers are lifted off the printing platen against the force of a spring, so that the forms can be inserted between the printing platen and the rollers. Subsequently, the rollers are lowered again and the record carrier is transported by rotation of the rollers and/or the printing platen. The record carrier is transported to the printing zone through a trough whose shape is adapted to the shape of the printing platen. During further transport the record carrier tends to move tangentially away from the printing platen. In order to ensure that the printing member, moving along the printing platen, does not disturb the introduction of the record carrier, the printing member is usually situated laterally outside the actual printing zone in which the record carrier is to be introduced.

In order to minimize the lifting off of the record carrier from the printing platen, it is known from German Auslegeschrift No. 25 03 642 to extend the already present guide trough as far as over the printing zone; however, it is then necessary to cut out the actual printing zone in the form of a wide window. The further guiding of the record carrier, therefore, is limited to the edge zones of the record carrier. Depending on the thickness of the record carrier, its center also tends to disengage from the printing platen. Moreover, such a construction of the guide trough has the disadvantage that it allows a record carrier to be fed only from behind and not from underneath the printing platen.

SUMMARY OF THE INVENTION

It is an object of the invention to provide a printing mechanism which also provides reliable guiding of the record carrier above the printing zone, so that the record carrier can be guided around the printing platen without additional manipulation. Preferably, the guiding means is constructed as a pivotable modular unit, so that it can be brought into an inoperative position when necessary. Such a printing mechanism would thus be suitable for use with different types of record carrier.

This object is achieved in that two or more flat hold-down devices are arranged on a pivotable shaft which is journalled in side portions, parallel to the printing platen; and when the shaft is pivoted, it moves the hold-down devices into a first position in which they engage the printing platen and into a second position in which they are lifted off the printing platen. At least one of the side portions includes a control device for pivoting the shaft, the control device being engaged by the printing member in at least one of its lateral positions.

Each hold down device is shaped as a flat S, the end which faces the printing member being adapted to the shape of the printing platen. Moreover, the hold-down device is pivotably connected to a bracket which can be pivoted by the shaft. As a result, the hold-down device can be moved in a direction substantially tangential to the platen surface and transverse to the axial direction of the platen by rotation of the shaft so that in the position for the introduction of the record carrier the front end disengages from the printing platen and the record carrier is automatically deflected to the printing platen. As the hold-down device is returned to the first position, it moves in the direction of insertion of the record carrier; as a result the record carrier need be inserted a minimum distance only, to permit printing close to the top edge of the carrier.

Preferably, each hold-down device also has associated with it a pressure roller which presses the record carrier against the printing platen. The pressure roller is resiliently mounted on a guide portion which is slidably arranged in the housing of the device.

The control device of a further embodiment in accordance with the invention consists of a slider which is connected to the shaft via a pivoting lever as well as of a lever which actuates the slider. The latter lever is situated within the range of the printing member, so that it can be pivoted by this member in its extreme position. Consequently, the complete device is automatically prepared for feeding of a record carrier as soon as the printing member has reached its extreme position. This extreme position may be, for example, the beginning of a line. Preferably, however, this extreme position is the rest position of the printing member which is normally situated a few steps outside the actual printing zone. Depending on the type of printing mechanism, the automatic control of the device in accordance with the invention can take place at the beginning as well as at the end of the printing zone. In the latter case, devices for the pivoting of the shaft must be provided on both side portions.

An embodiment in accordance with the invention will be described in detail hereinafter.

DESCRIPTION OF THE PREFERRED EMBODIMENT

Figure 1:
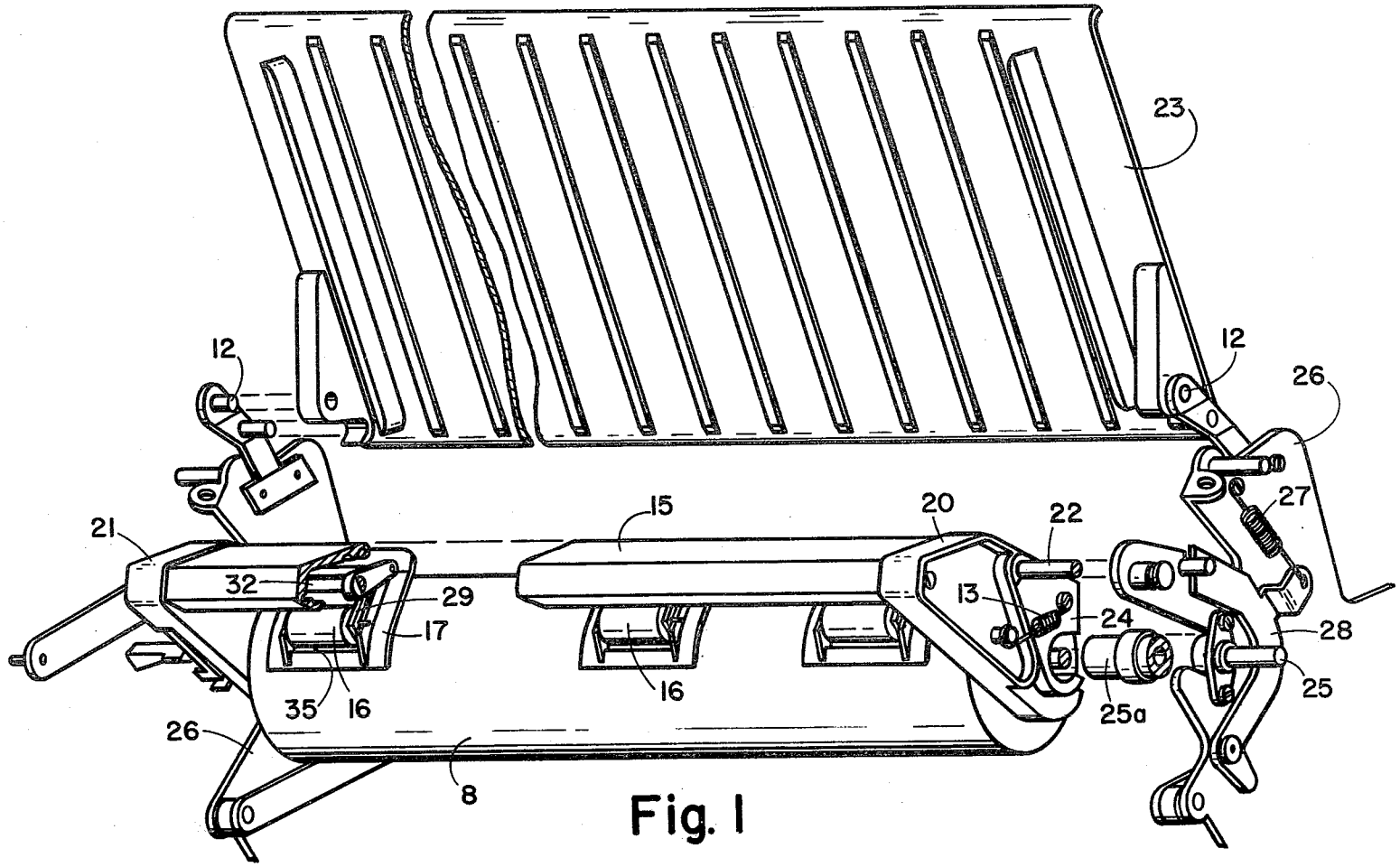
FIG. 1 is a perspective view of the printing mechanism in accordance with the invention.
Figure 3:
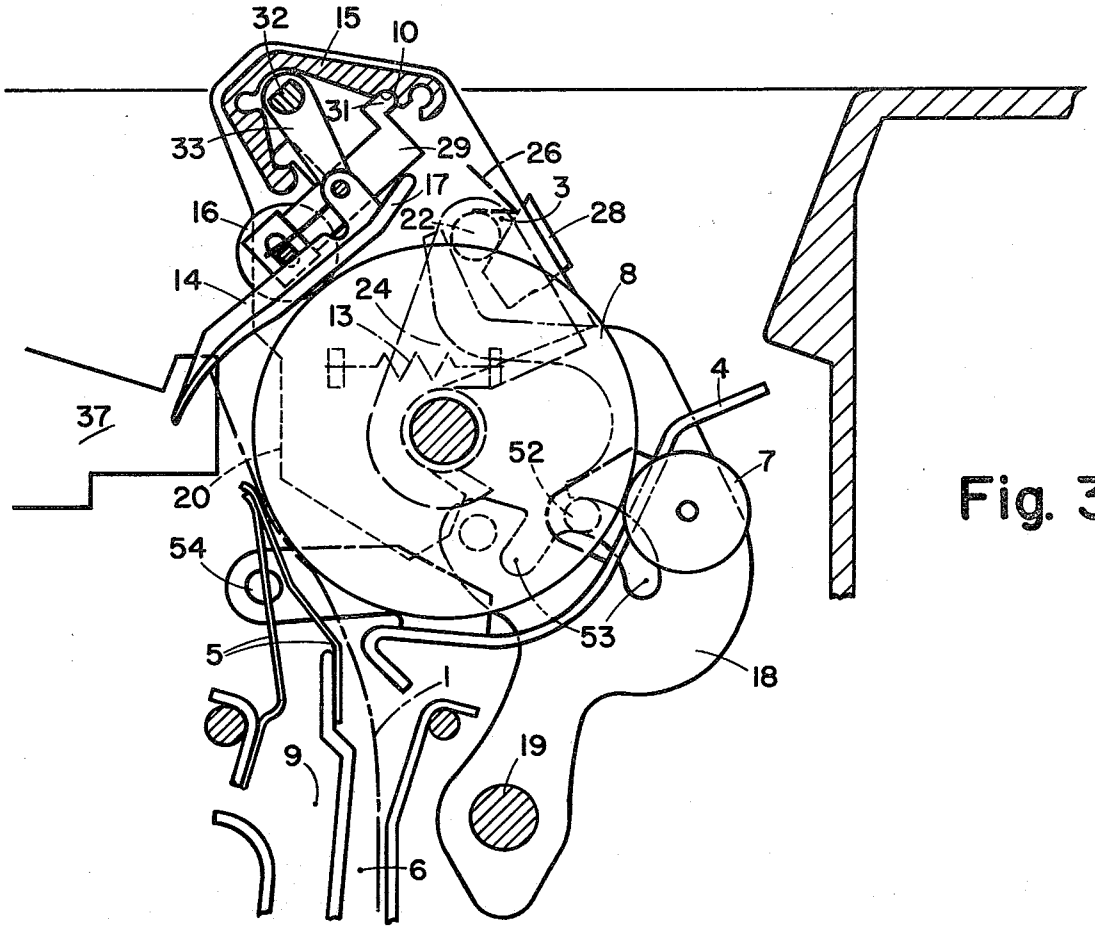
FIG. 3 shows the printing mechanism with the hold-down device in the deflected position.

FIG. 1 is a perspective view of the parts of a printing mechanism which are absolutely necessary for a proper understanding of the invention. The printing drum 8 is rotatably journalled in the side walls 26 of the printing mechanism by way of bearing bolts 25, only one of which is shown. A bush 25*a* is arranged on the bearing bolts 25. The means for guiding and feeding of a record carrier consists of a housing 15 and two side portions 20 and 21. Inside the housing 15 a shaft 32 is rotatably journalled in the side portions 20 and 21. The housing 15 can be mounted as a modular unit on the bearing bolts 25 of the printing drum 8. The holding levers 24, only one of which is shown in FIG. 1, are provided for this purpose. The holding levers are mounted on the bushes 25*a* by way of an integrated claw-like clamping portion. The upper portion of the holding levers 24 comprises a bolt 22 by means of which the levers are arranged in a recess 3 in the side walls 26 (FIG. 3). Each of the bolts 22 is retained in its recess 3 by a lever 28 in that the front end of the lever 28 is biased against the bolts 22 by a spring 27. A deflecting plate 23 can be mounted on the side walls 26 of the printing mechanism by means of the journals 12.

Figure 2:
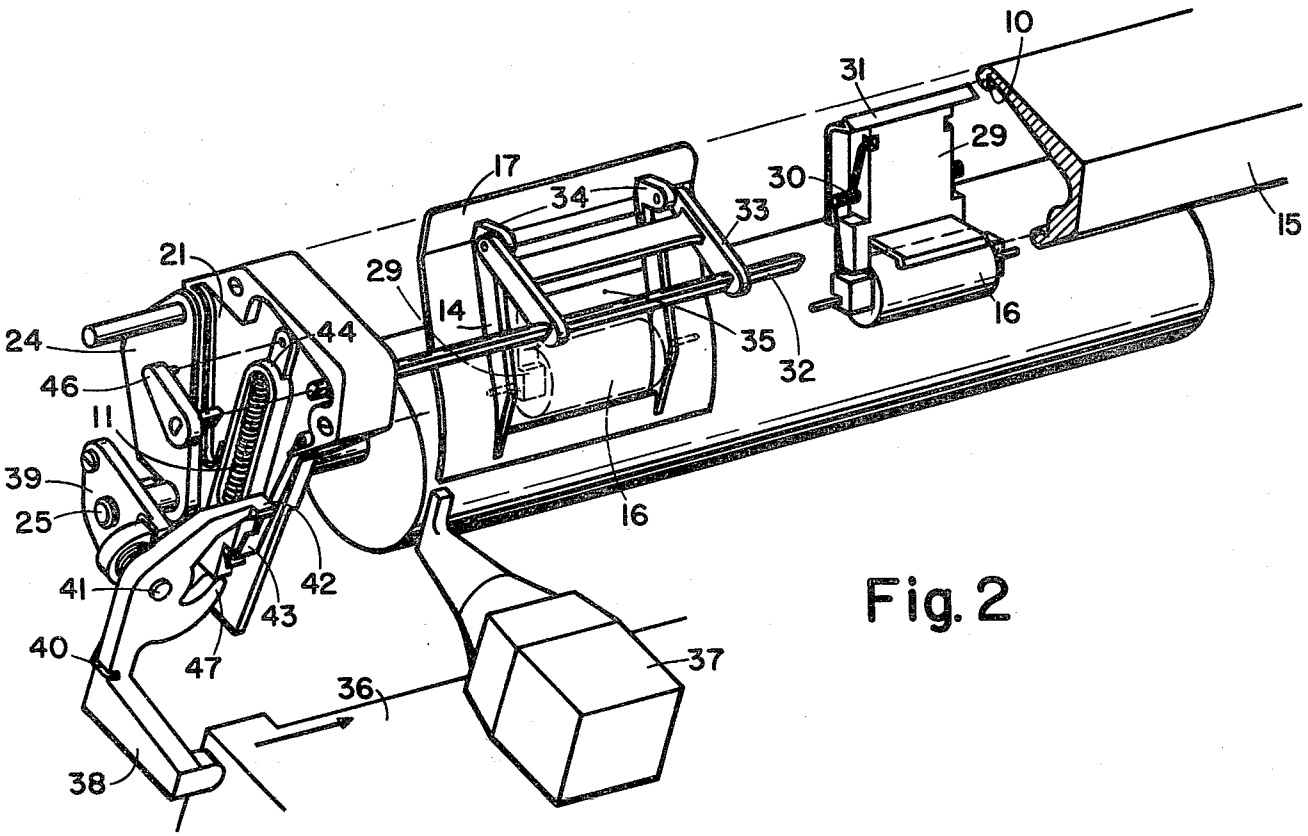
FIG. 2 shows details of the hold-down device and the control device.

As appears from FIG. 2, hold-down devices 17 are journalled on the shaft 32. These devices are constructed to be flat and have an elongate S-shape as appears from the FIGS. 3 and 4. The front end of the hold-down devices 17 is adapted to the shape of the drum 8. At the rear of the hold-down devices 17 there are provided projections 34 in which brackets 33 are journalled. The brackets 33 are pivoted by the shaft 32. The hold down device 17 comprises an opening 35 in which a guide portion 29 can be inserted. The guide portion 29 is separately shown in FIG. 2 for the sake of clarity. At the front end of the guide portion 29 there is journalled a pressure roller 16. The rotary shaft of the roller 16 is subject to the force of a torsion spring 30 which presses the shaft of the roller 16 against slanted portions 14 of the hold-down device 17. Moreover, at the rear of the guide portion 29 there is provided a guide profile 31 whereby it can be pivotably journalled in a sliding slit 10 in the housing 15.

FIG. 2 also shows that in the side portion 21 of the housing 15 there is arranged a control device which essentially consists of a slider 44 and a lever 38. The lever 38 is pivotably journalled on a bearing bolt 41 of a bearing block 39 and is retained in the position shown by the leg spring 40. The bearing block 39 is secured around the bearing bolt 25 on the side wall 26 of the printing mechanism in a manner not shown. One end of the lever 38 projects into the range of the printing member which consists of the printing head 37 and the carriage 36. The other end of the angle lever 38 has a claw-like construction, one claw 42 acting as a switching nose and the other claw 47 acting as an activation nose. The slider 44 is retained in the position shown by a spring 11. At the upper end of the slider 44 there is pivotably journalled a pivoting lever 46 which is rigidly connected to the shaft 32. When the slider is displaced by the angle lever 38, the shaft 32 is thus pivoted.

FIG. 3 is a side elevation of the mechanism with the hold-down device 17 in the deflected position. It is assumed, by way of example, that the record carrier 1 is supplied from underneath the printing drum 8 via the input channel 6. The record carrier 1 is fed to the printing drum 8 by the feed plate 5 underneath the printing head 37. The feed plate 5 acts as a pressure roller and takes over a part of the transport forces. Due to the pivoting of the shaft 32, the hold-down device 17 is pivoted forwards via the brackets 33, so that the front end of the hold-down device 17 is lifted off the printing drum 8. The pressure rollers 16 continue to engage the printing drum. When the record carrier 1 is introduced, its front edge is pressed against the hold-down device 17 and, thanks to the special shape of the front end of the hold-down device 17, it is guided in the direction of the printing drum 8.

When the record carrier is transported further by rotation of the printing drum, its front edge is engaged by the pressure rollers 16 so that thereby the same transport forces are produced as by the pressure rollers 7. It is thus achieved that not only the record carrier is transported completely out of the range of the printing drum, but also that lines can be correctly printed thereon up to the last line. This is also applicable to the upper part of the record carrier. This is because as soon as this part is situated underneath the front of the hold-down devices, it is already pressed against the printing drum. Consequently, the printing of the record carrier may commence immediately without the record carrier being engaged by the upper transport rollers 16.

Figure 4:
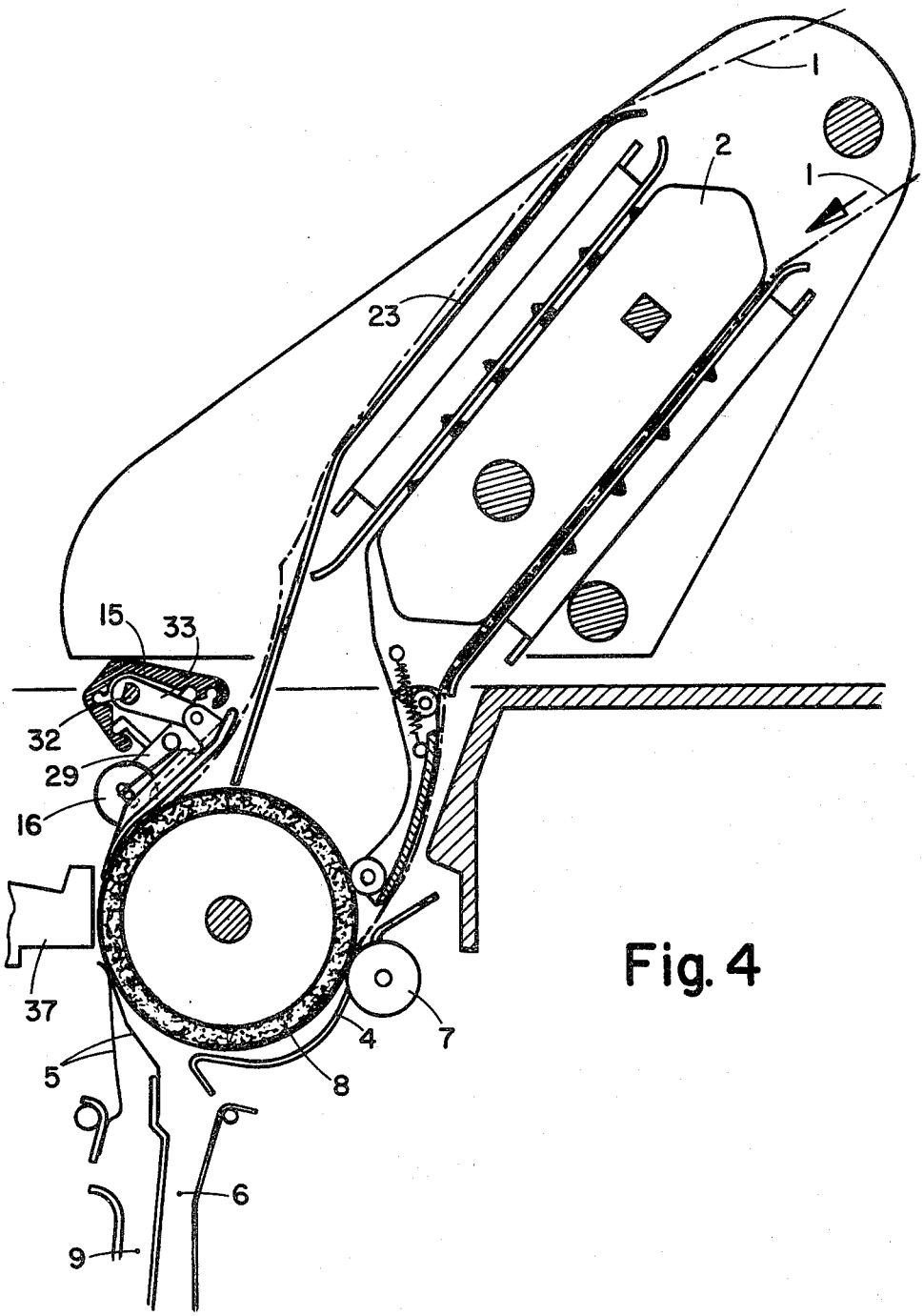
FIG. 4 shows the printing mechanism with the hold-down device in the engaging position.

FIG. 4 shows the situation in which the front end of the hold-down device 17 contacts the printing drum 8. In the present embodiment the record carrier 1 is fed to the printing drum 8 via the lower side of the transporter 2. It is guided around the printing drum 8 by the transport rollers 7 and the trough 4. Because the present embodiment comprises a deflection plate 23, the record carrier 1 is deflected upwards thereby. The pressure roller 16 is then pressed against the printing drum 8 by the torsion spring 30. The shaft of the pressure roller 16 is then lifted off the hold-down device 17 by a suitable design of the slanted portions 14.

Figure 5:
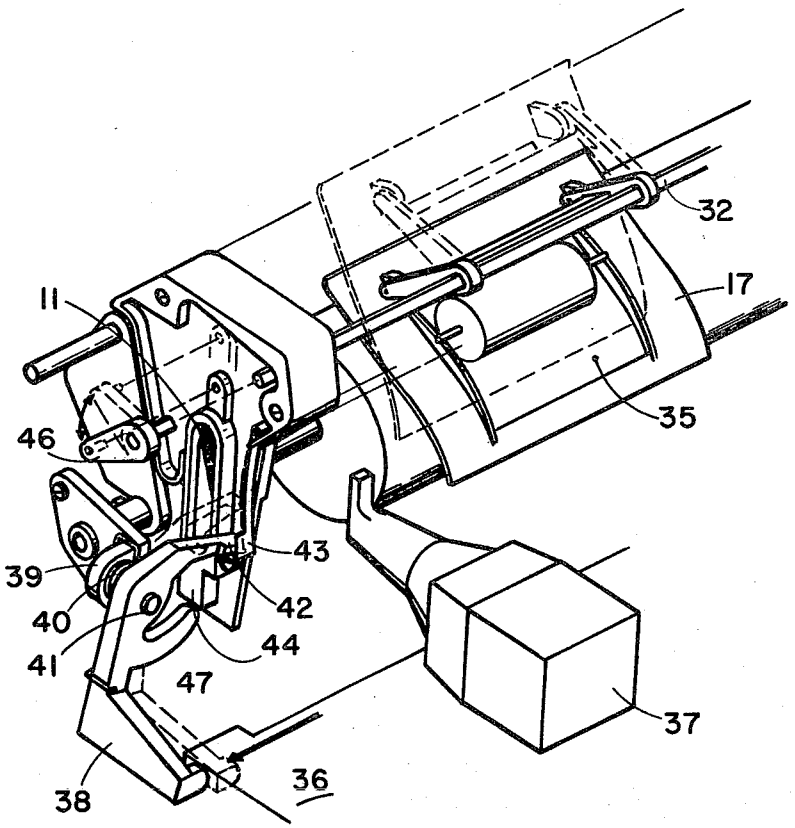
FIG. 5 shows the control device in both its pivoted positions.

FIG. 5 illustrates the operation of the control device. When the carriage 36 of the printing head 37 reaches the extreme position shown in which the printing head is situated outside the printing range, the lever 38 is pivoted from the position denoted by broken lines to the position denoted by solid lines. The switching nose 42 pivots the leaf spring 43, the angled end of which thus releases the slider 44. Due to the force of the tension spring 11, the slider is pivoted downwards from the position denoted by broken lines to the position denoted by solid lines. At the same time, the pivot lever 46 and the shaft 32 are also pivoted. The hold-down device 17 then reaches the position which is shown in detail and in which the front end is lifted off the printing roller. When the carriage 36 leaves its position shown after the introduction of a record carrier around the printing drum 8, the leg spring 40 ensures that the lever 38 initially follows the movement of the carriage 36 until it occupies a position which is denoted by broken lines. The actuation nose 47 then contacts the lower side of the slider 44 and lifts the slider against the force of the spring 11 into the position denoted by broken lines. At the same time, the shaft 32 is pivoted and the hold-down device 17 is returned to the position which is denoted by broken lines and in which the front end bears on the printing drum 8.

If the printing head 37 is moved back only to the start of the printing line during operation of the printing mechanism, as shown in FIG. 2, the angle lever 38 is not pivoted.

Other than in the embodiment shown in FIG. 5, one end of the lever 38 may be shaped so that the noses 42 and 47 continuously engage the slider 44. When the lever 38 is pivoted into the position shown, the slider 44 is then forced downwards by the nose 42 and is pulled back into the position denoted by broken lines again by the nose 47. In that case the leaf springs 43 and the tension spring 11 can be omitted, because the activation of the slider 44 is biased in both directions.

Printing mechanisms in office machines are often constructed so that different types of record carrier have to be clamped or guided around the printing drum in different manners. For example, an account card must be perpendicularly fed past the printing drum, while a chain form is fed by the transporter to the printing drum where it is deflected and returned to the transporter. The insertion of the chain form is realized by hand. To this end, the guide brackets of the transporter are placed in an open position and are closed again after the insertion of the chain form. For the transport of an account card, the printing mechanism is provided with an adapter device. Furthermore, it is also possible to supply a set of forms or sets of chain forms, via the lower side of the transporter, to the printing drum also from the rear. After deflection, the set of forms is no longer returned to the transporter but is deflected upwards by a guide plate.

When an account card is inserted, usually an endless or a chain form is also introduced into the printing mechanism. Because on the one hand the account card is not guided around the printing mechanism and on the other hand the chain form must be inserted by hand, automatic guiding and deflection of the record carrier around the printing drum is not required in this case. Therefore, the described device will not be necessary.

Figure 6:
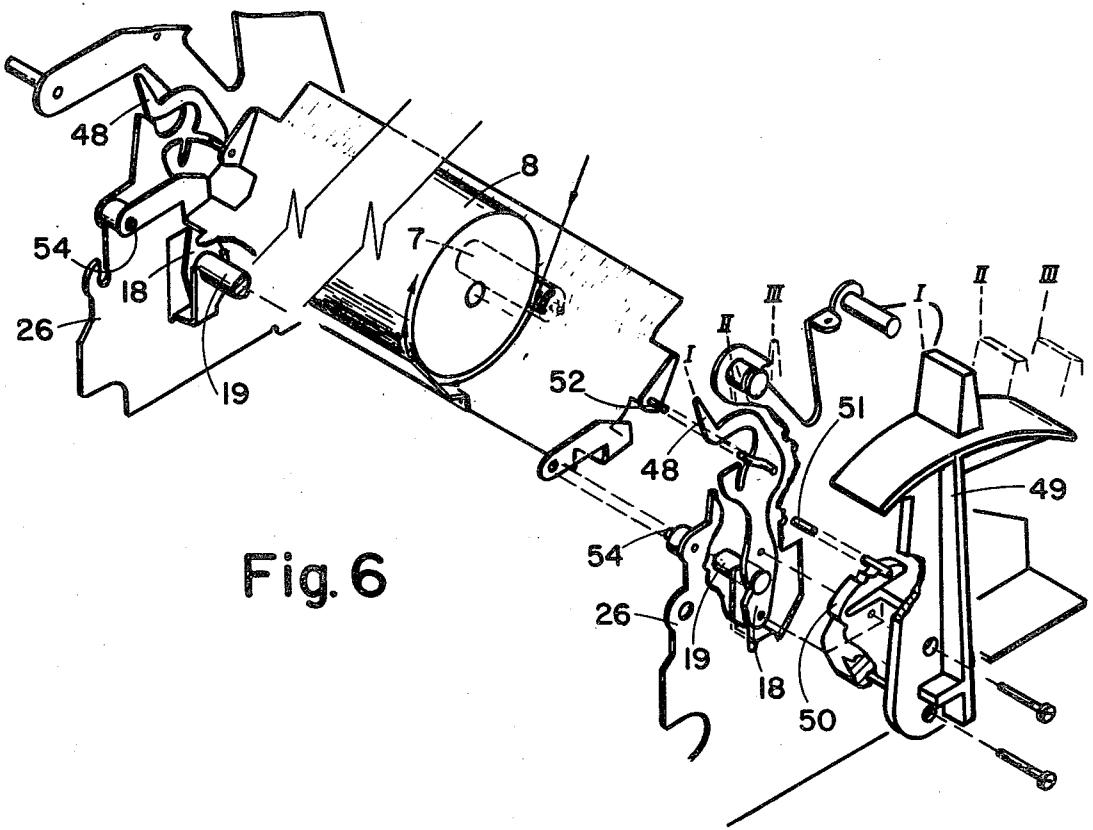
FIG. 6 shows a lever device for pivoting of the device shown in FIG. 1.

For this reason, as is shown in FIG. 6, on both sides of the device there are provided levers 18 which are rigidly interconnected by means of a shaft 19. The shaft 19 is journalled in the side walls 26 of the printing mechanism. At least one of the levers 18 is rigidly coupled to a manual lever 49 which comprises three latch positions I, II, III. To this end, a resilient projection 50 is provided with three notches in which a stationary pin 51 engages. When the manual lever 49 is moved, the levers 18 pivot the bolts 22 of the holding levers 24 and hence the housing 15.

FIG. 3 shows the device in the position II of the manual lever 49. It is adjusted when the record carrier 1, for example, a single form or a single sheet or a set of forms, is to be fed to the printing drum 8 from the rear via the pressure roller 7 or from below via the feed channel 6 and one of the spring plates 5. In this position the hold-down devices 17 are actuated in the described manner by the shaft 32 and by the extreme position of the carriage 36.

The trough 4 is journalled in a slit 53 in the lever 18 by way of a projection 52. In this position II, the trough 4 engages the printing drum 8. A further bearing of the trough 4, including the pressure rollers 7, is formed by the bearings 54 which are stationary as opposed to the projection 52.

Figure 7:
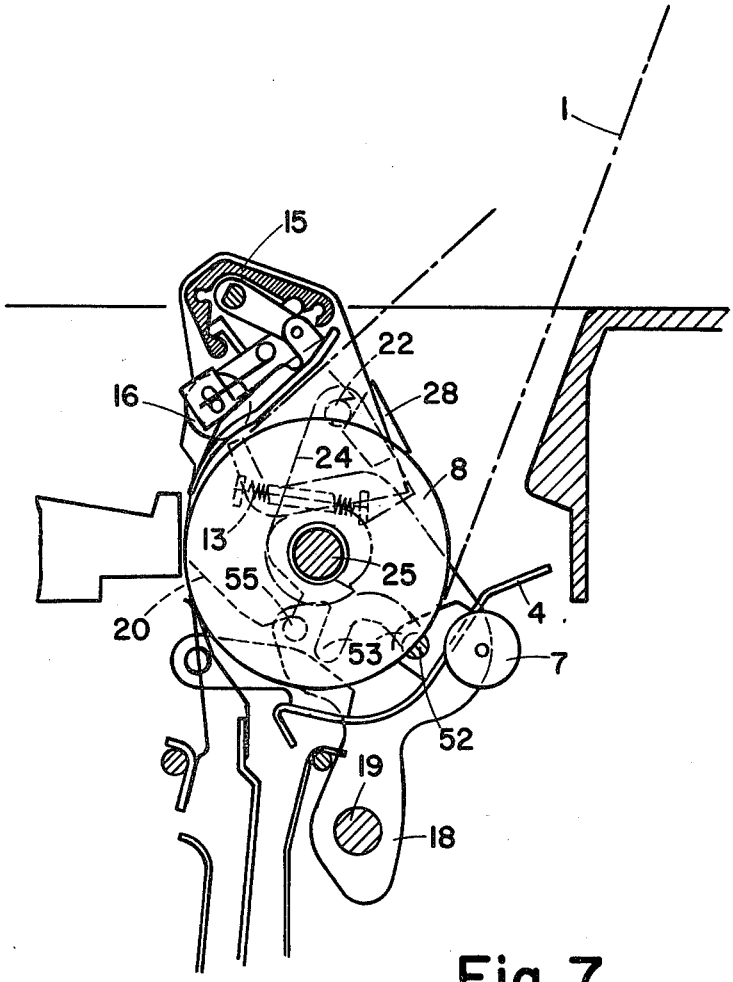
FIG. 7 shows the device in the backwards pivoted position.

When the manual lever 49 is pivoted forwards into the position I, the introduced record carrier 1, for example, a single form or sets of forms, can be manually aligned as is customarily done in typewriters. This position is shown in FIG. 7. When the manual lever 49 is pivoted, the projection 52 of the trough 4 slides to the bottom right in the guide slit 53 in the lever 18. The trough 4 is thus pivoted about the shaft 54. The pressure rollers 7 connected to the trough 4 are thus removed from the printing drum 8. Moreover, the bolts 55 connected to the lever 18 press the side portions 20 and 21 of the housing 15 forwards, so that the complete device is pivoted clockwise about the bolts 22 and the pressure rollers 16 are also lifted off the printing drum 8. When the manual lever 49 is returned from the position I to the position II, the springs 13 which are hooked onto the holding levers 24 and the side portions 20 and 21 pull the device back into the basic position shown in FIG. 3.

Figure 8:
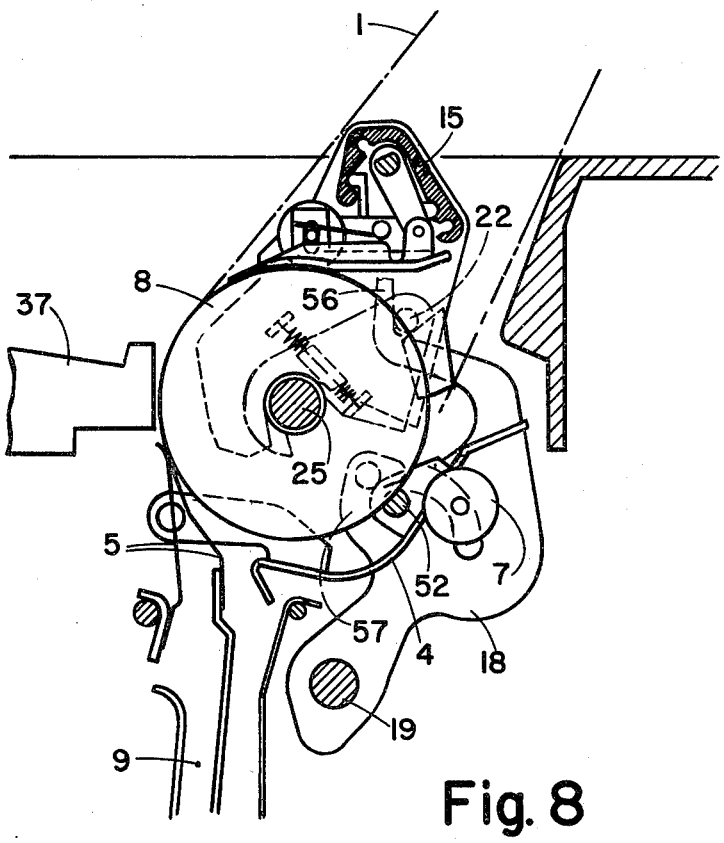
FIG. 8 shows a device in the forwards pivoting position.

When the manual lever 49 is pivoted backwards into the position III, the device is slid backwards in order to be deactivated. In the position III, an adapter device can be mounted over the printing drum 8 in a known manner which is not shown so that, for example, account cards can be inserted between the printing head 37 and the printing backing 8 and be applied to the channel 9 after deflection of the front spring plate 5. Moreover, in this position it is possible to introduce a chain form from the lower side of a transporter 2 to the printing drum and back again to the top side of the transporter 2. This possibility appears from FIGS. 8 and 4 after removal of the deflection plate 23.

Due to the pivoting of the manual lever 49, the projection 52 of the trough 4 is shifted to the bottom left in the slit 53, so that the trough 4 and the pressure rollers 7 are lifted off the printing drum 8. At the same time, when the lever 18 is pivoted about the bearing shaft 19, the nose 56 shifts the bolt 22 to the rear. The housing 15 is then pivoted about the bearing shaft 25 of the printing drum 8. As a result, the endless form can be introduced and processed without being disturbed by the device. Moreover, the feeding of the endless form under the pressure rollers 16 and the housing 15 can be dispensed with. Any misalignment of the endless form by the pressure rollers 7 and 16 is precluded. A further advantage is offered by the wide paper channel 57 between the trough 4 and the printing drum 8 and the widely opened pressure rollers 7, so that smooth paper transport is possible, notably for endless forms. Only the spring strip 5 which only lightly presses the record carrier 1 against the printing drum 8 remains active.

What is claimed is:

1. A printing mechanism comprising a circular cylindrical platen defining an axial direction, means for guiding and feeding a record carrier around the platen, and a printing member mounted to be displaceable in said axial direction between extreme positions, characterized in that said means for guiding and feeding comprises:

a plurality of hold-down devices movable in a direction substantially tangential to the platen surface, and transverse to said axial direction, between an engaging position and a deflecting position, in said engaging position said devices engaging the platen such as to hold an inserted record carrier against the platen, in said deflecting position said devices being lifted off the printing platen and forming guides which define a path followed by the leading edge of a record carrier being inserted around the platen, and control means for moving said devices between said positions, responsive to the printing member being in one of said extreme positions.

2. A mechanism as claimed in claim 1, characterized in that said devices move in the direction of feeding of a record carrier as the devices move from the deflecting to the engaging position.

3. A mechanism as claimed in claim 1, characterized in that said devices have a generally flat surface, concavely curved at a leading edge end opposite said platen when the devices are in the engaging position, the concavity corresponding to the shape of the platen.

4. A mechanism as claimed in claim 1 or 2, characterized in that each hold-down device has an opening therethrough, and the mechanism comprises a respective plurality of pressure rollers each arranged to extend through an opening in a respective hold-down device for engagement with the platen.

5. A mechanism as claimed in claim 4, characterized in that said pressure rollers are mounted for radial movement with respect to the platen axis, and said hold-down devices include means for moving said rollers radially out of engagement with the platen as the devices are moved from the engaging to the deflecting position.

6. A mechanism as claimed in claim 5, characterized in that the printer mechanism includes side portions to which said means for guiding and feeding is mounted, one of said side portions being disposed adjacent each end of the platen; a housing rigidly interconnecting said side portions; and a guide portion slidably arranged in said housing, said pressure rollers being respectively journalled on said guide portion.

7. A mechanism as claimed in claim 1, characterized in that the printer mechanism includes side portions to which said means for guiding and feeding is mounted, one of said side portions being disposed adjacent each end of the platen; and a pivotable shaft journalled in said side portions, arranged parallel to said platen axis, said hold-down devices being connected to said shaft for movement between said engaging and deflecting positions responsive to pivoting of the shaft.

8. A mechanism as claimed in claim 7, characterized in that said means for guiding and feeding comprises a plurality of brackets connected to said shaft for pivoting therewith, each device being pivotably connected to a respective bracket, and each of said brackets being displaceable on the shaft in the axial direction.

9. A mechanism as claimed in claim 7, characterized in that said control means consists of a slider and a lever, said lever having an end projecting into the path of movement of the printer member between said extreme positions and another end of the lever arranged to actuate the slider.

10. A mechanism as claimed in claim 9, characterized in that the end of the lever which actuates the slider is shaped as a claw.

11. A mechanism as claimed in claim 10, characterized in that the control means further comprises a spring arranged to apply biasing force against the lever, and the end of the lever which actuates the slider comprises a nose which is moved by the slider against said biasing force.

12. A mechanism as claimed in claim 9, 10 or 11, characterized in that the control means further comprises a pivot lever connecting the slider to the shaft.

13. A mechanism as claimed in claim 9, characterized in that said means for guiding and feeding further comprises a holding lever pivotably journalled with respect to the printing platen, and a housing connected to the holding lever, said shaft being pivotably connected to said housing.

14. A mechanism as claimed in claim 13, characterized in that said side portions each comprise a respective bearing bolt, for positioning a respective holding lever, and a spring loaded lever engaging the respective bearing bolt for retaining the bolt.

15. A mechanism as claimed in claim 14, characterized in that the platen includes a bearing shaft, and that the control means further comprises a pivotal lever which pivots the bearing bolts about said platen bearing shaft.

16. A mechanism as claimed in claim 15, characterized in that the mechanism further comprises a manual lever pivotably mounted with respect to said platen axis and having several latching positions, said lever being coupled to the pivotable lever for the bearing bolts.

17. A mechanism as claimed in claim 1, characterized in that said means for guiding and feeding further comprises a holding lever pivotably journalled with respect to the printing platen, and a housing connected to the holding lever, said shaft being pivotably connected to said housing.

18. A mechanism as claimed in claim 17, characterized in that said side portions each comprise a respective bearing bolt, for positioning a respective holding lever, and a spring loaded lever engaging the respective bearing bolt for retaining the bolt.

19. A mechanism as claimed in claim 18, characterized in that the platen includes a bearing shaft, and that the control means further comprises a pivotal lever which pivots the bearing bolts about said platen bearing shaft.

20. A mechanism as claimed in claim 19, characterized in that the mechanism further comprises a manual lever pivotably mounted with respect to said platen axis and having several latching positions, said lever being coupled to the pivotable lever for the bearing bolts.

* * * * *